US010637167B2

(12) United States Patent
Kitahara

(10) Patent No.: US 10,637,167 B2
(45) Date of Patent: Apr. 28, 2020

(54) SWITCH MOUNTING DEVICE AND PUSH SWITCH

(71) Applicant: Tokyo Parts Industrial Co., Ltd., Gunma-ken (JP)

(72) Inventor: Takahisa Kitahara, Gunma-ken (JP)

(73) Assignee: Tokyo Parts Industrial Co., Ltd. (JP)

( * ) Notice: Subject to any disclaimer, the term of this patent is extended or adjusted under 35 U.S.C. 154(b) by 0 days.

(21) Appl. No.: 16/355,954

(22) Filed: Mar. 18, 2019

(65) Prior Publication Data

US 2019/0341707 A1 Nov. 7, 2019

(30) Foreign Application Priority Data

May 1, 2018 (JP) ..... 2018-088194
Feb. 26, 2019 (JP) ..... 2019-032319

(51) Int. Cl.
*H01R 9/16* (2006.01)
*H01R 9/22* (2006.01)
*H01R 4/02* (2006.01)

(52) U.S. Cl.
CPC ..... *H01R 9/16* (2013.01); *H01R 4/027* (2013.01); *H01R 9/22* (2013.01)

(58) Field of Classification Search
CPC ..... H01R 9/16; H01R 4/027; H01R 9/22
USPC ..... 200/341
See application file for complete search history.

(56) References Cited

U.S. PATENT DOCUMENTS 6,420,670 B1 * 7/2002 Yu ..... H01H 13/568 200/341
2012/0006664 A1 1/2012 Kitahara et al.
2013/0248336 A1 9/2013 Kitahara
2017/0025235 A1 1/2017 Kitahara
2017/0213660 A1 * 7/2017 Kitahara ..... H01H 9/04

FOREIGN PATENT DOCUMENTS

JP 2103-197074 A 9/2013

* cited by examiner

*Primary Examiner* — Edwin A. Leon
*Assistant Examiner* — Iman Malakooti
(74) *Attorney, Agent, or Firm* — Jordan and Koda, PLLC

(57) ABSTRACT

A switch mounting device comprises: a resin seat having an upper surface and a lower surface; a switch mounted on the upper surface of the seat; and terminal members fixed to the lower surface. The seat has claw parts on the lower surface thereof. The switch has a main body part, which is operated by pressing in the X direction, and connection terminals extending downward from this main body part. With connection terminals led out to the lower surface of the seat, the connection terminals are electrically connected to the terminal members. The terminal members are fixed to the seat by the claw parts by way of being slid along the lower surface of the seat.

8 Claims, 6 Drawing Sheets

SWITCH MOUNTING DEVICE AND PUSH SWITCH

BACKGROUND OF THE INVENTION

The present invention relates to a push switch provided, for example, in a vehicle or the like.

Examples of push switches include the push switch described in Japanese Patent Laid-Open Publication No. 2013-197074, which comprises: a switch disposed on a seat; a tubular case that accommodates the seat and the switch; and a soft button mounted on the upper part of the case and having a peripheral side wall and an upper operation wall.

In this push switch, the switch has a main body part and an operating part projecting upward from the main body part. Furthermore, the upper operation wall has a pressing part that presses the operating part. Furthermore, the seat comprises a base part on which the switch is mounted, a cover part positioned at the periphery of the main body part, and an upper wall positioned above the cover part and covering the switch. Furthermore, the upper wall has a through-hole at a position corresponding to the operating part, a space is arranged so as to be provided to the inside of the upper operation wall, and the operating part and the pressing part face each other via this through-hole.

In the push switch described above, when the upper operation wall of the button is pressed, the pressing part pushes the operating part downward, while being elastically deformed, so as to turn the switch on, and a signal is sent to the exterior by lead wires connected to terminals of the switch.

The terminals of this switch are formed as four terminals which are led out downward through through-holes provided in the base part of the seat and through-holes provided in conductive terminal members mounted on the lower surface of the base part, and are electrically connected to the terminal members by solder or the like.

However, in the conventional push switch described above, because the terminal members are simply mounted on the lower surface of the seat, irregularities tend to occur in the electrical connection between the terminals of the switch and the terminal members, such that failures occur due to play in the switch, such that there is a risk that the push switch will not operate in response to a predetermined pressing operation.

SUMMARY OF THE INVENTION

One or more embodiments of the present invention provide a switch mounting device capable of solving the aforementioned problems found in conventional push switches, and a push switch comprising this switch mounting device.

Note that, in the aspects described below, the constituent elements employed can be used in the most freely chosen combinations possible. Furthermore, the aspects and technical features of the present invention are not limited to those described hereafter, and are to be understood based on the description in the entire specification and the drawings or the inventive ideas that can be grasped by the skilled artisan on the basis of these descriptions.

A first aspect of the present invention is a switch mounting device, comprising:

a resin seat having an upper surface and a lower surface; a switch mounted on the upper surface; and terminal members fixed to the lower surface, wherein:

the seat has claw parts on the lower surface;

the switch has a main body part, which is operated by pressing in the X direction, and connection terminals extending downward from the main body part;

with the connection terminals led out, through the seat, to the lower surface, the connection terminals are electrically connected to the terminal members; and the terminal members are fixed by the claw parts by way of sliding the terminal members in the Y direction orthogonal to the X direction along the lower surface.

A second aspect of the present invention is a push switch comprising a switch mounting device, a tubular case, and a soft button, wherein:

the switch mounting device comprises a resin seat having an upper surface and a lower surface; a switch mounted on the upper surface; and terminal members fixed to the lower surface, wherein:

the seat has claw parts on the lower surface;

the switch has a main body part, which is operated by pressing in the X direction, and connection terminals extending downward from the main body part;

with the connection terminals led out, through the seat, to the lower surface, the connection terminals are electrically connected to the terminal members;

the terminal members are fixed by the claw parts by way of sliding the terminal members in the Y direction orthogonal to the X direction along the lower surface;

the case has an opening in an upper part thereof, and the switch mounting device is fixed at the interior thereof; and the button is mounted on an upper part of the case and, by being pressed in the X direction, the main body part of the switch is operated by pressing.

In the switch mounting device according to the present invention, the terminal members can be fixed to the lower surface of the seat by the claw parts provided on the seat simply by sliding the terminal members along the lower surface of the seat. Therefore, stable electrical connections can be made between the terminal members and the connection terminals of the switch without using a separate member, and a push switch having excellent reliability can be realized.

DETAILED DESCRIPTION OF THE PREFERRED EMBODIMENTS

Figure 1:
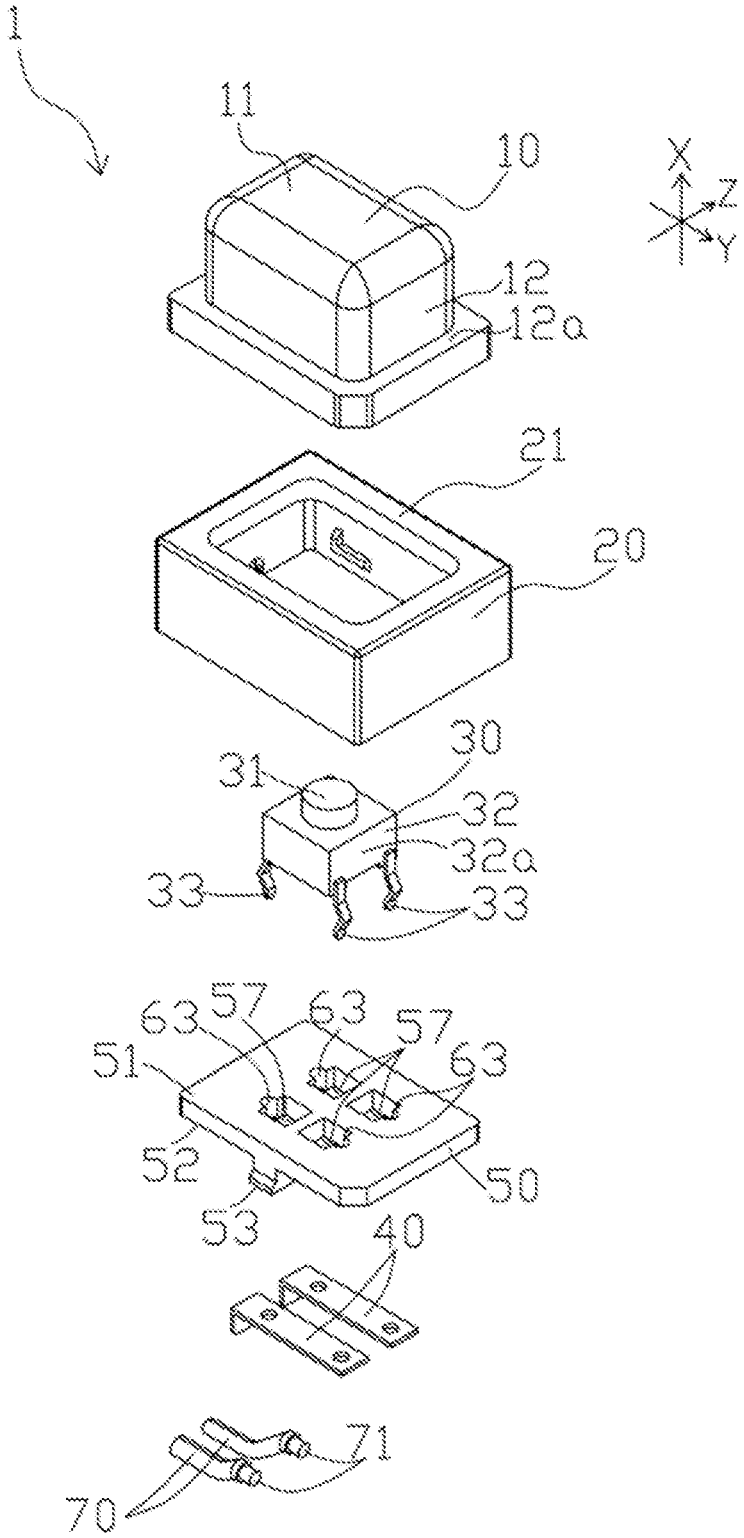
FIG. 1 is an exploded perspective view of a push switch according to a first exemplary mode of embodiment of the present invention.
Figure 2:
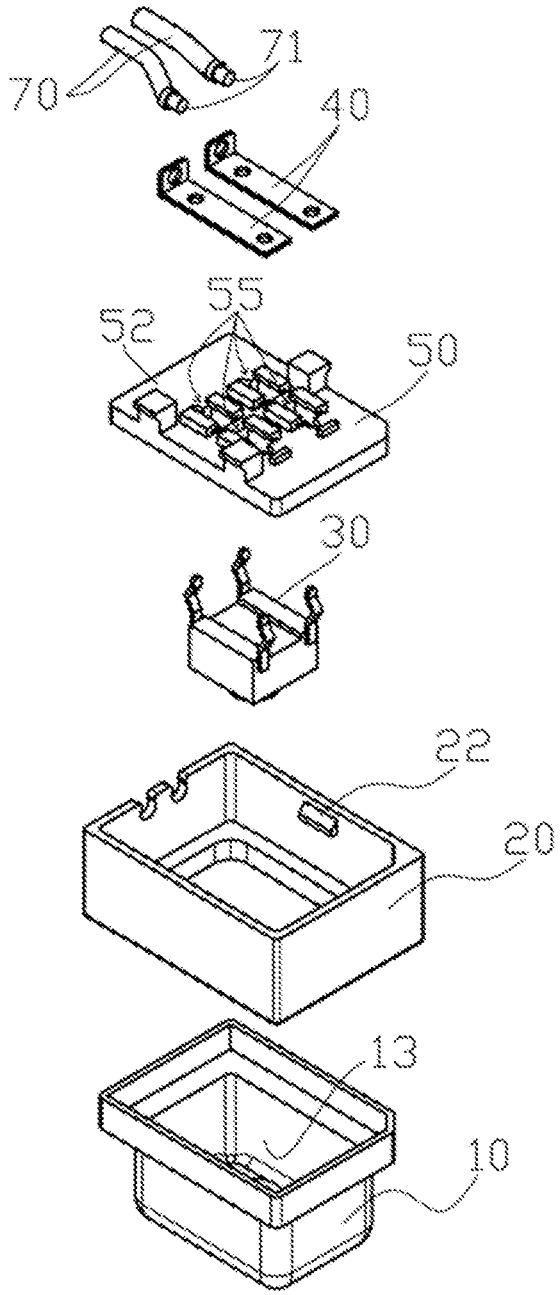
FIG. 2 is an exploded perspective view of the push switch in FIG. 1, viewed from another angle.
Figure 3:
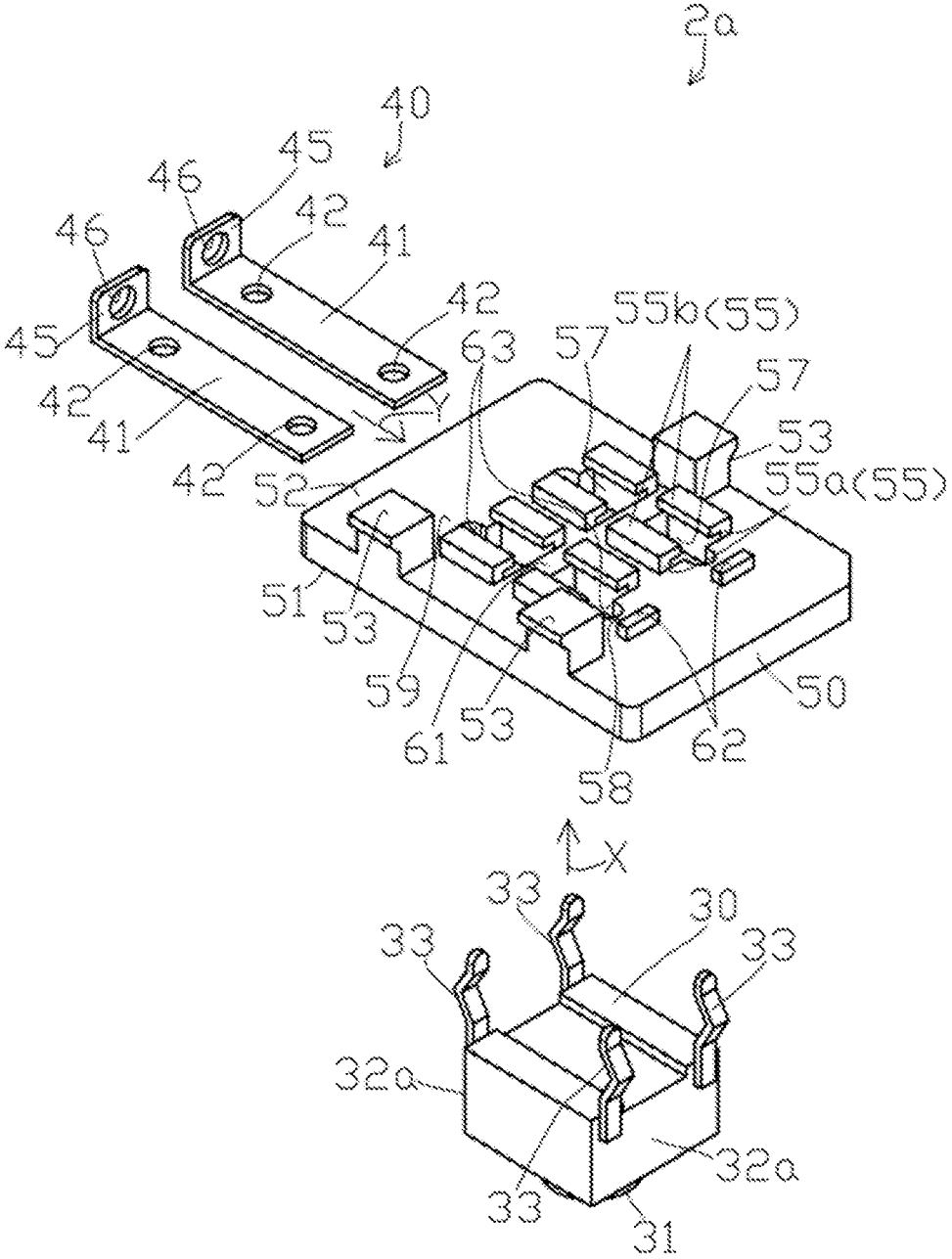
FIG. 3 is a perspective view serving to describe a method for assembling the switch mounting device in FIG. 2.
Figure 4:
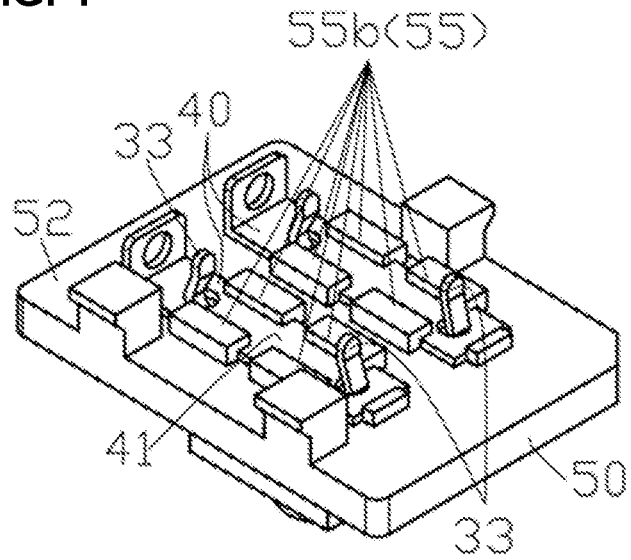
FIG. 4 is a perspective view of the completed switch mounting device in FIG. 2.
Figure 5:
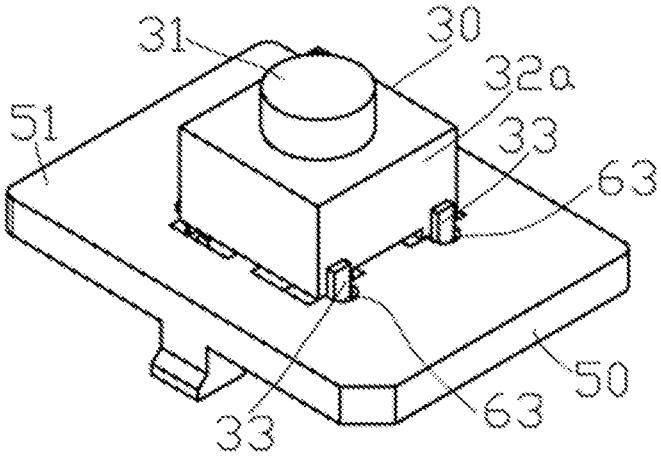
FIG. 5 is a perspective view of the completed switch mounting device in FIG. 4, viewed from another angle.

Hereinafter modes of embodiment of the present invention are illustratively described based on the drawings. Note that, in the present specification, the vertical direction as in FIG. 1 is described as the vertical direction, and the X, Y, and Z directions, which are orthogonal to each other, as in FIG. 1, are described as the X direction, the Y direction, and the Z direction.

First Exemplary Mode of Embodiment

A push switch 1 according to a first exemplary mode of embodiment of the present invention will be described with reference to FIG. 1 to FIG. 7.

The push switch 1 of this example comprises a button 10, a case 20, a switch 30, terminal members 40, and a seat 50. The seat 50, the switch 30, and the terminal members 40 form a switch mounting device 2*a*.

The button 10 is integrally formed of a soft elastic resin such as rubber, and comprises a planar rectangular upper operation wall 11 and a peripheral side wall 12 descending from the periphery thereof, so as to have an opening 13 at the bottom. An outward flange part 12*a* is formed on the peripheral side wall 12.

The case 20 is integrally formed from hard resin in a tubular shape that is open at the top and the bottom, and has an inward flange part 21 on the upper inside, and inward protruding parts 22 in the lower inside. Note that the inward flange part 21 is formed on the entire inner circumference, and the inward protruding parts 22 are independently formed in three places. The button 10 is fitted on the case 20 in a manner such that the upper surface of the outward flange part 12*a* of the button 10 abuts the lower surface of the inward flange part 21 of the case 20.

The switch 30 has a columnar operating part 31, a cuboid main body part 32, and connection terminals 33. The operating part 31 projects upward from the inside of the main body part 32 and is movable in the X direction, being urged upward as illustrated in FIG. 1 by an elastic member (not shown) within the main body part 32. The connection terminals 33 project downward as a total of four connection terminals 33, two each from mutually facing side faces 32*a* of the main body part 32. The connection terminals 33 are formed in a dogleg shape, which also projects from the main body part 32 in the Y direction. The four connection terminals 33 have the same shape. The positions of the two connection terminals 33 formed on one side surface 32*a* of the main body part 32 are positioned so as to overlap with the two connection terminals 33 formed on the other side surface 32*a* of the main body part 32, when viewed from the Y direction. The switch 30 is mounted on the seat 50, and the switch 30 and the seat 50 are accommodated within the case 20, in which the button 10 has been fit.

The terminal members 40 are made of a conductive material, two of which being mounted on the lower surface 52 of the seat. Specifically, the terminal members 40 have a flat rectangular flat part 41 and a standing part 45, which is erected from one end of the flat part 41. A through-hole 46 for fixing a lead wire 70 to be connected, by soldering, to the terminal member 40, is formed in the standing part 45.

The seat 50 is formed from a thermoplastic resin, in a flat shape, having an upper surface 51 and a lower surface 52, and outward protruding parts 53, which engage with the case 20, and claw parts 55 which engage with the terminal members 40, are integrally molded on the lower surface 52. The switch 30 is mounted on the upper surface 51 of the seat. The outward protruding parts 53 are independently formed in three places, and the claw parts 55 are independently formed in four places.

The seat 50, on which the switch 30 has been mounted, is fixed in the case 20 in which the button 10 has been fit. Specifically, with the outer periphery of the upper surface 51 of the seat abutting against the lower surface of the outward flange part 12*a* of the button 10, the outward protruding parts 53 of the seat 50 engage with the inward protruding parts 22 of the case 20, such that the seat 50 is fixed inside the case 20. Furthermore, the operating part 31 of the switch 30 faces the upper operation wall 11 of the button 10, such that pressing force of the button 10 will be applied to the switch 30.

The terminal members 40 are fixed to the lower surface 52 of the seat by the claw parts 55. Specifically, by sliding the two terminal members 40 in the Y direction, along the lower surface 52 of the seat, the two terminal members 40 are fixed in two rows, having the same orientation, by the claw parts 55. Note that, the terminal members are formed so that the entire length thereof in the Y direction is shorter than the length of the entire seat in the Y direction.

The claw parts 55 have a standing part 55 projecting in the X direction from the lower surface 52 of the seat, and an engaging part 55*b* projecting in the Z direction from the lower end of the standing part 55*a*. Cuboid through-holes 57 are formed in the seat 50, in order to be able to form the claw parts 55 with a metal mold that opens and closes in the X direction. The claw parts 55 are formed adjacent to the through-holes 57, and due to these through-holes 57, the engaging parts 55*b* do not overlap with any part of the seat 50 in the X direction.

Two through-holes 57 are formed independently in the Y direction, and a support part 61 is formed between the two through-holes 57. The reason for this is so as to prevent deformation of the flat part 41 by way of the support part 61 when the terminal member 40 is slid between the claw parts 55, so that the terminal member 40 can be smoothly inserted between the claw parts.

At each through-hole 57, two claw parts 55 are formed facing each other in the Z direction, on the two lateral side surfaces of the flat part 41. A space that can accommodate a portion of the outer shape of the flat part 41 is formed between the standing parts 55*a* of the two claw parts 55 that face each other in the Z direction for each through-hole 57 and thus the flat part 41 can slide inside the claw parts. That is to say, the distance between the standing parts 55*a* of the two claw parts 55 that face each other in the Z direction is the same as the width of the flat part 41 in the Z direction, and the height of the standing parts 55*a* in the X direction is equal to the height of the flat part 41 in the X direction.

A forward surface 58 and a rearward surface 59 are formed on the lower surface 52 of the seat, forward and rearward, in the Y direction, of the through-hole 57, and when the terminal member 40 is slid between the claw parts 55, the upper surface of the flat part 41 is in contact with the forward surface 58 and the rearward surface 59. That is to say, the outer peripheral edge of the lower surface of the flat part 41 is supported by the engaging parts 55*b*, while the upper surface of the flat part 41 is in contact with the forward surface 58 and the rearward surface 59 of the seat 50. The intermediate part of the flat part 41 in the Y direction is supported in contact with the support part 61.

Abutting parts 62, against which the distal ends of the terminal members 40 abut, are integrally formed on the lower surface 52 of the seat. The abutting parts 62 are formed adjacent to the forward surfaces 58, and one abutting part 62 is independently formed for each terminal member 40.

Four through-holes 63 are formed in the seat 50, through which the connection terminals 33 are led out to the lower surface 52. The positions of the through-holes 63 are the same positions as the positions of the connection terminals 33 when the switch 30 is mounted on the upper surface 51 of the seat. Two through-holes 63 are formed in one row in the Y direction for each terminal member 40, and two through-holes 57 are formed in one row in the Y direction between the two through-holes 63.

Two through-holes 42, into which the connection terminals 33 are inserted, are formed in one row in the Y direction in each terminal member 40. When the terminal members 40 are fixed in the seat 50 by way of sliding, the positions of the through-holes 42 are such that these are formed at the same positions as the positions of the connection terminals 33 when the switch 30 is mounted on the upper surface 51 of the seat 50. That is to say, when viewed from the X direction, the positions of the connection terminals 33, the through-holes 63, and the through-holes 42 in the terminal members are such that these are formed at the same positions. Furthermore, the outermost ends of the dogleg shaped connection terminals 33 in the Y direction are positioned to the outside of the through-holes 63 when viewed from the X direction.

Note that the through-holes 63 and the through-holes 57 are connected to each other.

The positions of the through-holes 42 are such that these are formed at positions that do not overlap with the claw parts 55 in the X direction, when the terminal member 40 is fixed in the claw part 55 by way of sliding.

The connection terminals 33 are led out downward through the through-holes 63 and the through-holes 42 and are electrically connected to the terminal members 40 by solder or the like. Conductive wires 71 of the lead wires are electrically connected to the standing parts 45 of the terminal members 40, and the lead wires 70 are led out to the outside of the case 20.

Figure 6:
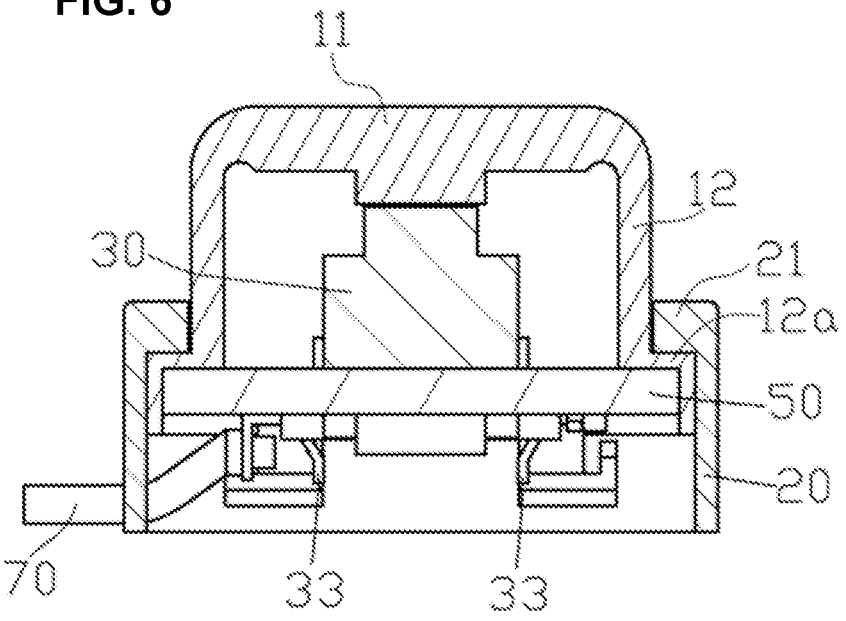
FIG. 6 is a cross-sectional view of the completed push switch in FIG. 1.
Figure 7:
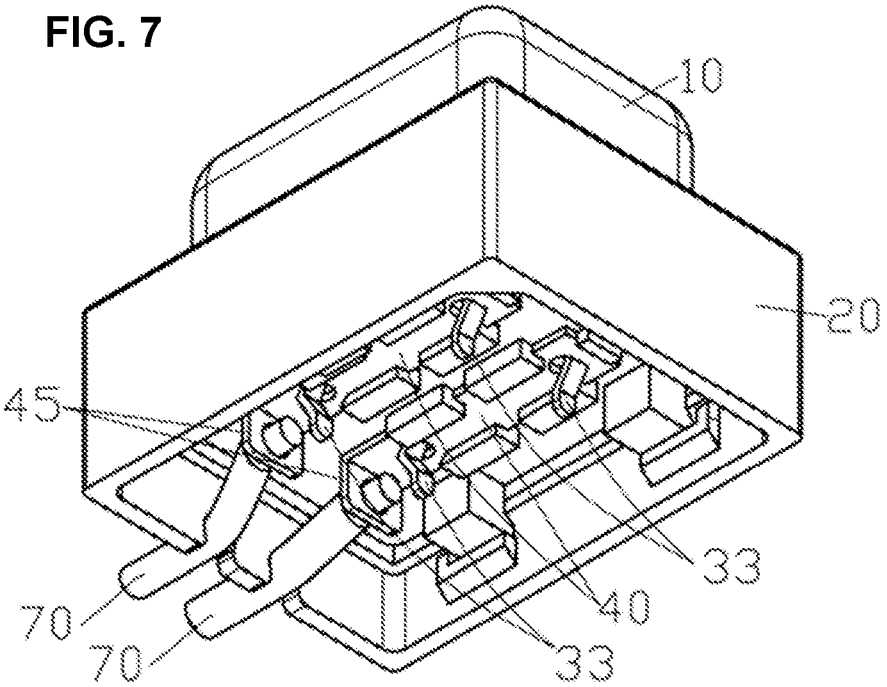
FIG. 7 is a perspective view of the completed push switch in FIG. 1.

With the push switch 1 in this example, which is configured as described above, when the upper operation wall 11 of the button 10 is pressed from above in the downward direction in FIG. 6, the operating part 31 of the switch 30 is pushed downward, such that the switch is turned on and a signal is sent to the outside by the lead wires 70.

As described above, the switch mounting device 2*a* of this example comprises: the resin seat 50 having the upper surface 51 and the lower surface 52; the switch 30 mounted on the upper surface 51; and the terminal members 40 fixed to the lower surface 52. The seat 50 has a plurality of claw parts 55 on the lower surface 52. The switch 30 has the main body part 32, which is operated by pressing in the X direction, and the connection terminals 33 extending downward from the main body part 32. With the connection terminals 33 led out to the lower surface 52 of the seat 50, the connection terminals 33 are electrically connected to the terminal members 40. The terminal members 40 are fixed by a plurality of claw parts 55 by way of sliding the terminal members 40 in the Y direction orthogonal to the X direction along the lower surface 52.

In the switch mounting device 2*a* of this example, the terminal members 40 can be fixed to the lower surface 52 of the seat 50 by the claw parts 55, simply by sliding the terminal members 40 along the lower surface 52 of the seat 50. Therefore, even if the seat 50 is subjected to some sort of impact or the like before the solder connection is made between the connection terminals 33 of the switch 30 and the terminal members 40, the terminal members 40 can be reliably prevented from being displaced downward from the lower surface 52 of the seat. Therefore, a stable electrical connection can be made between the terminal members 40 and the connection terminals 33 of the switch, in a state in which the switch 30 is in close contact with the upper surface 51 of the seat 50, and thus a push switch having excellent reliability can be realized.

Furthermore, in the switch mounting device 2*a* of this example, the plurality of claw parts 55 have a standing part 55 projecting in the X direction from the lower surface 52 of the seat, and an engaging part 55*b* formed projecting in the Z direction from the standing part 55*a*. Furthermore, the terminal members 40 are such that, the outer peripheral edges of the lower surface of the flat part 41 are supported by the engaging parts 55*b*, while the upper surface of the flat part 41 is in contact with the lower surface 52 of the seat 50. Therefore, the terminal members 40 can be securely fixed to the lower surface 52 of the seat 50 without the terminal members 40 separating from the lower surface 52 of the seat 50.

Furthermore, in the switch mounting device 2*a* of this example, the engaging parts 55*b* do not overlap with any part of the seat 50 in the X direction. If claw parts were formed on the lower surface of a solid seat, it would be necessary to have a mold that opens in the X direction and a mold that opens in the Y direction, making it difficult to increase the number of seats produced. However, with the mode in this example, the seat and the claw parts can be formed with only a mold that opens in the X direction, and therefore the number of seats produced can easily be increased.

Furthermore, in the switch mounting device 2*a* of this example, the abutting parts 62, against which the distal end of the terminal members 40 abut, are provided on the lower surface 52 of the seat. Accordingly, it is possible to prevent variations in the position of the terminal members 40 in the Y direction when the terminal members 40 are slid in the Y direction along the lower surface 52 of the seat, such that the fitting of the switch 30 on the seat 50 and the electrical connection of the terminal members 40 and the connection terminals 33 of the switch can be performed reliably.

Through holes 42, into which the connection terminals 33 are inserted, are formed in the terminal members 40, and the through-holes 42 and the claw part 55 are formed at positions that do not overlap when viewed from the X direction. Accordingly, when soldering the connection terminals 33 and the flat part 41, the soldering iron is unlikely to strike the engaging parts 55*b*, which are made of resin, whereby deformation of the claw parts 55 due to heat can be prevented, and thus loss of the holding force of the claw parts 55 can be prevented.

Furthermore, the push switch 1 of this example comprises the switch mounting device 2*a*, the tubular case 20 in which the switch mounting device 2*a* is fixed, and the soft button 10 which is fitted so as to close the opening in the upper part of the case 20 and operates the main body part 32 by pressing, as a result of being pressed in the X direction. Accordingly, the push switch 1 of this example can operate as a waterproof push switch.

Second Exemplary Mode of Embodiment

Figure 8:
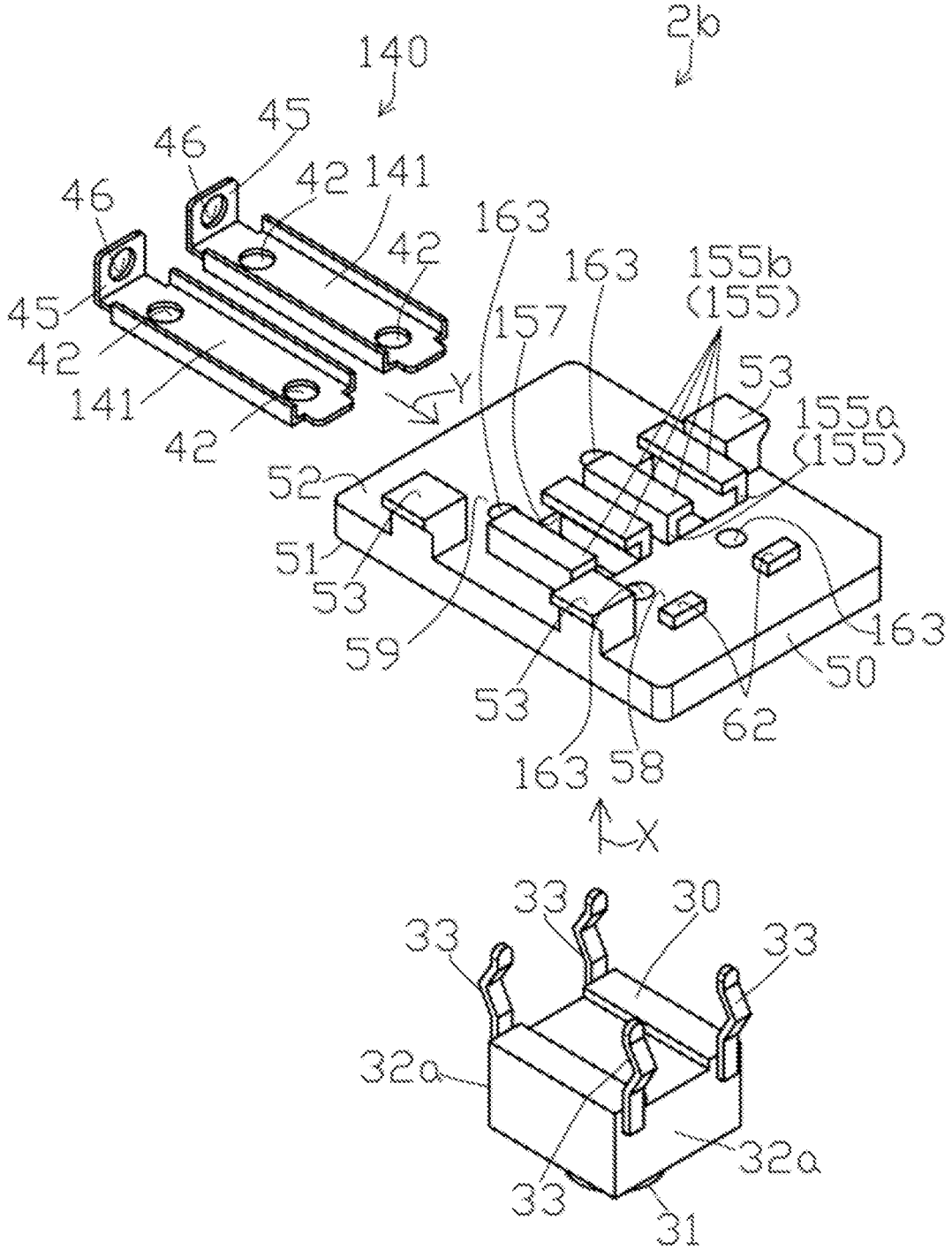
FIG. 8 is a perspective view serving to describe a method for assembling the switch mounting device according to a second embodiment of the present invention.

A switch mounting device 2*b*, which is a second exemplary mode of embodiment of the present invention, will be described using FIG. 8. In FIG. 8, the same reference numerals are given to parts that are equivalent to those in FIG. 1 to FIG. 7, and description of redundant parts is omitted.

The flat parts 41 of the terminal members in the first exemplary mode of embodiment are flat, but flat parts 141 of the terminal members in the second exemplary mode of embodiment are formed in a cross-sectionally concave shape in which both side surfaces in the Z direction are bent at right angles in the X direction. The standing parts 155*a* and the engaging parts 155*b* of the claw parts 155 are formed so as to match the flat parts 141. Specifically, the height in the X direction of the standing parts 155*a* is formed to be equal to the height in the X direction of the flat parts 141, and the engaging parts 155*b* are formed projecting in the Z direction from the lower end of the standing parts 155*a*.

Furthermore, in the first exemplary mode of embodiment, two through-holes 57 in the seat are formed in one row in the Y direction for each terminal member 40, but in the second exemplary mode of embodiment, a single through-hole 157 is formed in the seat, for the purposes of molding the claw parts 155 with a metal mold that opens and closes in the X direction for each terminal member 140. The through-holes 157 and the four through-holes 163 through which the connection terminals 33 are led out to the lower surface 52 are not connected, but rather are formed independently. Accordingly, since the mechanical strength of the flat part 141 in the second exemplary mode of embodiment can be made greater than that of the flat part 41 in the first exemplary mode of embodiment, it is possible to substantially eliminate deformation of the terminal members when the terminal members 140 are slid along the lower surface 52 of the seat.

Modes of embodiment of the present invention have been described above, but the present invention is not limited to the modes discussed above, and can be practiced with various modifications other than those discussed above, within a scope that does not depart from the gist thereof.

In the modes discussed above, the connection terminals 33 are led out to the lower surface 52 via the through-holes 63, 163, but it suffices that the connection terminals 33 are led out to the lower surface 52 through the seat 50 and, for example, the connection terminals may be led out to the lower surface through a notch formed on the outer circumferential face of the seat.

In the exemplary modes of embodiment discussed above, the connection terminals 33 are formed so as to project as a total of four connection terminals 33, two each from the mutually facing side surfaces of the main body part but, so long as the switch press-signal is transmitted, the connection terminals may be formed so as to project as a total of two connection terminals 33, one each from the mutually facing side surfaces of the main body part.

In the modes discussed above, the terminal members have a quadrangular flat part and a standing part erected from a predetermined position of the flat part but, so long as the lead wire can be electrically connected to the flat part, the terminal members may have only the flat part without providing a standing part.

What is claimed is:

1. A switch mounting device, comprising:

a resin seat having an upper surface and a lower surface; a switch mounted on the upper surface; and terminal members fixed to the lower surface, wherein:

the seat has a plurality of claw parts on the lower surface;

the switch has a main body part, which is operated by pressing in the X direction, and connection terminals extending downward from the main body part;

with the connection terminals led out, through the seat, to the lower surface, the connection terminals are electrically connected to the terminal members;

the terminal members are fixed by the plurality of claw parts by way of sliding the terminal members in the Y direction orthogonal to the X direction along the lower surface of the seat;

each one of the plurality of the claw parts has a standing part projecting in the X direction from the lower surface of the seat and an engaging part formed projecting from the standing part in the Z direction orthogonal to the X direction and the Y direction;

the terminal members have a flat part formed in a flat shape, and with the upper surface of the flat part in contact with the lower surface of the seat, the outer peripheral edges of the lower surface of the flat part are supported by the plurality of engaging parts; and the engaging parts do not overlap any part of the seat in the X direction.

2. The switch mounting device according to claim 1, wherein:

the lower surface of the seat has abutting parts against which distal ends of the terminal members abut.

3. The switch mounting device according to claim 1, wherein:

through-holes into which the connection terminals are inserted are formed in the terminal members; and the through-holes and the claw parts are formed at positions that do not overlap when viewed from the X direction.

4. A push switch comprising a switch mounting device, a tubular case, and a soft button;

wherein the switch mounting device comprises a resin seat having an upper surface and a lower surface, a switch mounted on the upper surface, and terminal members fixed to the lower surface;

wherein the seat has a plurality of claw parts on the lower surface;

wherein the switch has a main body part, which is operated by pressing in the X direction, and connection terminals extending downward from the main body part;

wherein with the connection terminals led out, through the seat, to the lower surface, the connection terminals are electrically connected to the terminal members;

wherein the terminal members are fixed by the plurality of claw parts by way of sliding the terminal members in the Y direction orthogonal to the X direction along the lower surface of the seat;

wherein the case has an opening in an upper part thereof, and the switch mounting device is fixed at the interior thereof;

wherein the button is mounted on an upper part of the case and, by being pressed in the X direction, the main body part of the switch is operated by pressing;

wherein each one of the plurality of the claw parts has a standing part projecting in the X direction from the lower surface of the seat and an engaging part formed projecting from the standing part in the Z direction orthogonal to the X direction and the Y direction;

wherein the terminal members have a flat part formed in a flat shape, and with the upper surface of the flat part in contact with the lower surface of the seat, the outer peripheral edges of the lower surface of the flat part are supported by the plurality of engaging parts; and wherein the engaging parts do not overlap any part of the seat in the X direction.

5. The push switch according to claim 4, wherein:

the lower surface of the seat has abutting parts against which distal ends of the terminal members abut.

6. The push switch according to claim 4, wherein:

through-holes into which the connection terminals are inserted are formed in the terminal members; and the through-holes and the claw parts are formed at positions that do not overlap when viewed from the X direction.

7. The switch mounting device according to claim 1, wherein each one claw part of the plurality of claw parts of the seat is located adjacent one through opening of a plurality of through openings in the seat, and wherein for said each one claw part the engaging part is aligned with said adjacent one through opening so as not to align in the x direction with any other portion of the seat.

8. The push switch according to claim 4, wherein each one claw part of the plurality of claw parts of the seat is located adjacent one through opening of a plurality of through openings in the seat, and wherein for said each one claw part the engaging part is aligned with said adjacent one through opening so as not to align in the x direction with any other portion of the seat.

* * * * *